US005270145A

United States Patent [19]

Willis et al.

[11] Patent Number: 5,270,145

[45] Date of Patent: * Dec. 14, 1993

[54] HEAT IMAGE SEPARATION SYSTEM

[75] Inventors: Roland G. Willis; John Texter, both of Rochester, N.Y.

[73] Assignee: Eastman Kodak Company, Rochester, N.Y.

[ * ] Notice: The portion of the term of this patent subsequent to Nov. 17, 2009 has been disclaimed.

[21] Appl. No.: 804,877

[22] Filed: Dec. 6, 1991

[51] Int. Cl.[5] ..... G03C 8/00

[52] U.S. Cl. ..... 430/203; 430/223; 430/226; 430/350; 430/351

[58] Field of Search ..... 430/203, 226, 351, 350, 430/223, 211

[56] References Cited

U.S. PATENT DOCUMENTS

| | | | |
|---|---|---|---|
| 2,971,840 | 2/1961 | Haydn et al. | 430/203 |
| 3,227,550 | 7/1966 | Whitmore et al. | 430/226 |
| 3,531,286 | 9/1970 | Renfrew | 430/351 |
| 4,022,617 | 5/1977 | McGuckin | 96/29 D |
| 4,062,684 | 12/1977 | Hara et al. | 430/203 |
| 4,187,108 | 2/1980 | Willis | 430/203 |
| 4,584,267 | 4/1986 | Masukawa et al. | 430/619 |
| 4,590,154 | 5/1986 | Hirai et al. | 430/559 |
| 4,891,304 | 1/1990 | Nakamura | 430/223 |
| 4,948,698 | 8/1990 | Komamura | 430/203 |
| 4,952,474 | 8/1990 | Tsukahara et al. | 430/138 |
| 4,957,848 | 9/1990 | Takahashi et al. | 430/203 |
| 5,066,563 | 12/1991 | Aono et al. | 430/203 |
| 5,164,280 | 11/1992 | Texter et al. | 430/202 |

FOREIGN PATENT DOCUMENTS

| | | | |
|---|---|---|---|
| 261500 | 5/1963 | Australia | 430/226 |
| 635811 | 2/1964 | Belgium | 430/203 |
| 602607 | 8/1960 | Canada | 430/226 |
| 0307713 | 3/1989 | European Pat. Off. . | |
| 3-56200 | 8/1991 | Japan . | |
| 4-73751 | 3/1992 | Japan . | |
| 904365 | 8/1962 | United Kingdom | 430/226 |

OTHER PUBLICATIONS

Patent Abstracts of Japan, vol. 9, No. 101, May 1985 (Japanese 59/224 844 Abstract).

*Primary Examiner*—Charles L. Bowers, Jr.
*Assistant Examiner*—M. Angebranndt
*Attorney, Agent, or Firm*—Paul A. Leipold

[57] ABSTRACT

A process for forming a dye image including the steps of: (a) exposing a photographic element comprising a light sensitive silver halide emulsion layer containing a color coupler compound capable of forming a heat transferable dye upon development; (b) developing the exposed element resulting from step (a) with a color developer solution to form a heat transferable dye image; (c) heating the exposed, developed element resulting from step (b) to thereby transfer the dye image from the emulsion layer to a dye receiving layer which is part of the photographic element or part of a separate dye receiving element brought into contact with the photographic element; and (d) separating the emulsion layer from the dye receiving layer containing the transferred dye image; wherein the color coupler compound is of the following formula (I):

COUP—B (I)

wherein COUP represents a coupler moiety capable of forming a heat transferable dye upon reaction of the coupler compound with an oxidized product of the developing solution of step (b); and B is hydrogen or a coupling-off group which is separated from COUP upon reaction of the coupler compound with an oxidized product of the developing solution of step (b). The process combines "wet" development with conventional developing solutions and "dry" separation of the developed image from the emulsion layer by heat transfer.

13 Claims, No Drawings

HEAT IMAGE SEPARATION SYSTEM

CROSS REFERENCE TO RELATED APPLICATIONS

This application is related to copending, commonly assigned, concurrently filed U.S. Ser. Nos. 07/805,717 of Texter et al. and 07/804,868 of Bailey et al., the disclosures of which are incorporated by reference.

TECHNICAL FIELD

This invention relates to photographic systems and processes for forming a dye image in a light sensitive silver halide emulsion layer, and subsequently separating the dye image from the emulsion layer.

BACKGROUND

In conventional "wet" silver halide based color photographic processing systems, an imagewise exposed photographic element, for example color paper designed to provide color prints, is processed in a color developer solution. The developer reduces the exposed silver halide of the photographic element to metallic silver and the resulting oxidized developer reacts with incorporated dye-forming couplers to yield dye images corresponding to the imagewise exposure. As silver is generally gray and desaturates the pure colors of the dyes, it is desirable to remove it from the dye images. Silver is conventionally separated from the dye images by a process of bleaching the silver to a silver halide and removing the silver halide by using an aqueous solvent, a fixing bath. This fixing bath also removes the undeveloped original silver halide. Commonly, the bleach and fix are combined into one solution, a bleach-fix solution.

Bleach-fix solutions commonly contain iron, ammonium, ethylenediaminetetraacetic acid, thiosulfate and, after use, silver. These components of "wet" silver halide processing are the source of much of the pollution from photofinishing processes.

"Dry" silver halide based color photographic processing systems have been proposed which employ thermally developable color photographic material. Such thermally developable materials generally comprise a light sensitive layer containing silver halide, a photographic coupler or other dye-providing material, and a color developing agent as disclosed, e.g., in U.S. Pat. Nos. 4,584,267 and 4,948,698 and references cited therein. After image-wise exposure, these elements can be developed by uniformly heating the element to activate the developing agent incorporated therein, thereby eliminating the need for wet processing with a developer solution. In some thermally developable systems, the dye-providing materials are designed to form diffusible dyes upon heat development, which may be transferred to an image-receiving layer either during thermal development or thereafter in a separate step. Such thermally developable diffusion transfer color photography systems are disclosed in U.S. Pat. Nos. 4,584,267 and 4,948,698 referenced above. These systems also eliminate the need for bleach-fix steps with processing solutions and the resulting effluent wastes.

While dry processing systems as discussed above are beneficial in that they eliminate the need for processing solutions and the resulting waste, they require additional materials, such as developing agents, to be incorporated into the thermally developable photographic element itself. Also, the levels of silver halide necessary for heat developable systems are generally substantially higher than those required for conventional wet systems. The presence of such additional materials can detrimentally affect the cost, performance, and storage properties of such elements.

It would be desirable to provide a photographic processing system which would reduce the amount of waste processing solution effluents generated by the overall processing system while retaining the benefits of image quality and industry compatability which are derived from wet development with conventional developing solutions.

SUMMARY OF THE INVENTION

These and other objects of the invention are achieved in accordance with this invention which comprises a process for forming a dye image comprising the steps of: (a) exposing a photographic element comprising a light sensitive silver halide emulsion layer containing a color coupler compound capable of forming a heat transferable dye upon development; (b) developing the exposed element resulting from step (a) with a color developer solution to form a heat transferable dye image; (c) heating the exposed, developed element resulting from step (b) to thereby transfer the dye image from the emulsion layer to a dye receiving layer which is part of the photographic element or part of a separate dye receiving element brought into contact with the photographic element; and (d) separating the emulsion layer from the dye receiving layer containing the transferred dye image; wherein the color coupler compound is of the following formula (I):

$$\text{COUP—B} \qquad \text{(I)}$$

wherein COUP represents a coupler moiety capable of forming a heat transferable dye upon reaction of the coupler compound with an oxidized product of the developing solution of step (b); and B is hydrogen or a coupling-off group which is separated from COUP upon reaction of the coupler compound with an oxidized product of the developing solution of step (b).

DETAILED DESCRIPTION

The coupler compound of formula (I) which is to be contained in the color photographic material to be used in the process of the invention is designed to be developable by conventional color developer solutions, and to form a heat transferable dye upon such conventional development. While color images may be formed with coupler compounds which form dyes of essentially any hue, couplers which form heat transferable cyan, magenta, or yellow dyes upon reaction with oxidized color developing agents are used in preferred embodiments of the invention.

Couplers which form cyan dyes upon reaction with oxidized color developing agents are described in such representative patents and publications as U.S. Pat. Nos. 2,474,293, 2,772,162, 2,801,171, 2,895,826, 3,002,836, 3,419,390, 3,476,563, 3,779,763, 3,996,253, 4,124,396, 4,248,962, 4,254,212, 4,296,200, 4,333,999, 4,443,536, 4,457,559, 4,500,635 and 4,526,864, the disclosures of which are incorporated by reference. Preferred cyan coupler structures are phenols and naphthols which can form heat transferable cyan dyes on reaction with oxidized color developing agent. These structures include the following moieties:

C-1

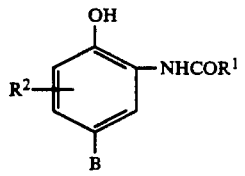

C-2

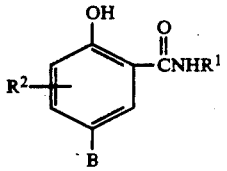

C-3

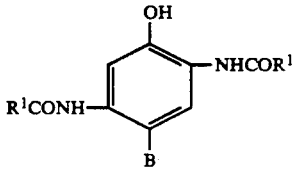

C-4

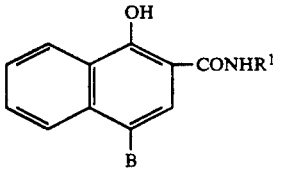

where $R^1$ represents substituted or unsubstituted alkyl (preferably lower alkyl, e.g., methyl, ethyl, butyl, trifluoromethyl) or aryl (e.g., alkoxy or halogen substituted phenyl), $R^2$ represents hydrogen or one or more halogen atoms (e.g., chloro, fluoro), substituted or unsubstituted alkyl (preferably lower alkyl, e.g., methyl, ethyl, butyl) or alkoxy (preferably lower alkoxy, e.g., methoxy, ethoxy, butoxy) groups and B is hydrogen or a coupling off group.

Couplers which form magenta dyes upon reaction with oxidized color developing agents are described in such representative patents and publications as U.S. Pat. Nos. 1,969,479, 2,311,082, 2,343,703, 2,369,489, 2,600,788, 2,908,573, 3,061,432, 3,062,653, 3,152,896, 3,519,429, 3,725,067, 4,120,723, 4,500,630, 4,540,654 and 4,581,326, and European Patent Publication Nos. 170,164 and 177,765, the disclosures of which are incorporated by reference. Preferred magenta couplers include pyrazolones, pyrazolotriazole, and pyrazolobenzimidazole compounds which can form heat transferable dyes upon reaction with oxidized color developing agent. These structures include the following moieties:

M-1

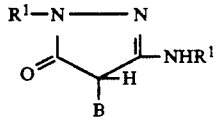

M-2

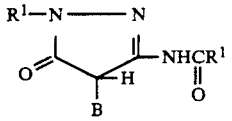

-continued

M-3

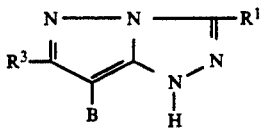

M-4

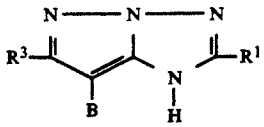

M-5

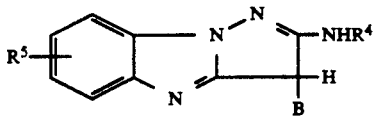

wherein B and $R^1$ are as defined above; $R^3$ is halogen, (e.g., chloro, fluoro) or substituted or unsubstituted alkyl (preferably of from 1 to 4 carbon atoms), alkoxy (preferably of from 1 to 4 carbon atoms), or aryl (preferably phenyl, e.g., 2,4,6-trichlorophenyl); $R^4$ is substituted or unsubstituted aryl or acyl (preferably phenyl or acylphenyl, e.g., 2,6-dichlorophenyl); and $R^5$ is hydrogen or one or more halogen (e.g., chloro, fluoro) or substituted or unsubstituted alkyl, alkoxy, amino, sulfonyl, or carboxy group (preferably of from 1 to 4 carbon atoms, e.g., methyl, butyl, ethoxy, butoxy, $NHC(O)CF_3$, $NHSO_2CH_3$, $NHC(O)CH_3$, $CO_2CH_3$, $CO_2C_2H_5$, $SO_2NH_2$, $SO_2NHCH_3$).

Couplers which form yellow dyes upon reaction with oxidized color developing agent are described in such representative U.S. Pat. Nos. as 2,298,443, 2,875,057, 2,407,210, 3,265,506, 3,384,657, 3,408,194, 3,415,652, 3,447,928, 3,542,840, 4,046,575, 3,894,875, 4,095,983, 4,182,630, 4,203,768, 4,221,860, 4,326,024, 4,401,752, 4,448,536, 4,529,691, 4,587,205, 4,587,207 and 4,617,256, the disclosures of which are incorporated by reference. Preferred yellow dye image forming couplers are acylacetamides, such as benzoylacetanilides and pivalylacetanilides, which can form heat transferable dyes upon reaction with oxidized color developing agent. These structures include the following moieties:

Y-1

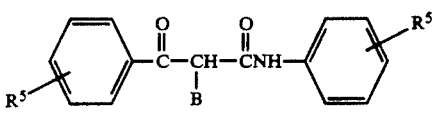

Y-2

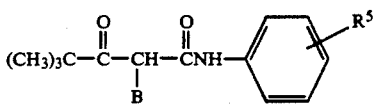

Y-3

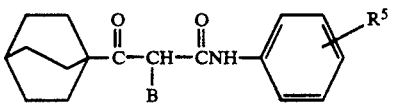

Y-4

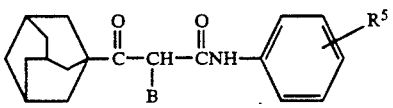

-continued

Y-5

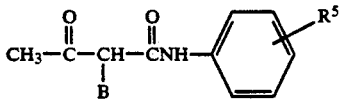

Y-6

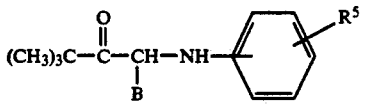

Y-7

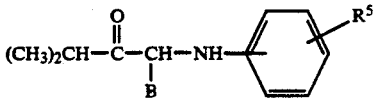

Y-8

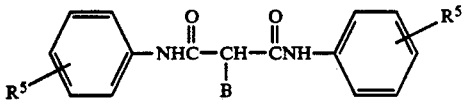

wherein B and $R^5$ are as defined above.

In the above formulas, B represents hydrogen or a coupling-off group. Coupling-off groups for coupler compounds are well known in the photographic art. During photographic processing, the reaction of a coupler compound with oxidized color developing agent cleaves the bond between the coupling-off group and the coupler moiety and forms a dye with the coupler moiety. Coupling-off groups may contain photographically useful groups such as development inhibitors, development accelerators, developing agents, electron transfer agents, color couplers, azo dyes, etc., as is well known in the art.

In a preferred embodiment of the invention, B represents a ballasted coupling-off group, meaning that it contains a ballast group of sufficient size and configuration as to confer on the molecule sufficient bulk to render it substantially non-diffusible from the layer in which it is coated. Representative ballast groups include substituted and unsubstituted alkyl or aryl groups typically containing from about 8 to about 40 carbon atoms.

Representative examples of coupling-off groups suitable for use in the coupler compounds used in the invention include those of the following formulas:

B-1

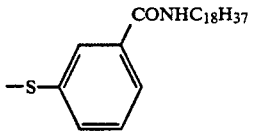

B-2

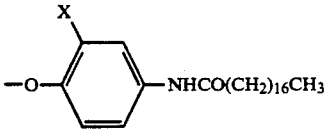

Where X represents, e.g., H, $SO_3Na$ or $SO_3K$

B-3

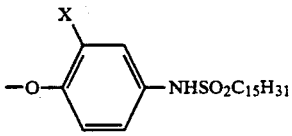

Where X represents, e.g., H, $SO_3Na$ or $SO_3K$

-continued

B-4

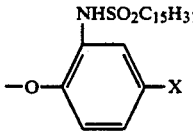

Where X represents, e.g., OH, $SO_3Na$ or $SO_3K$

B-5

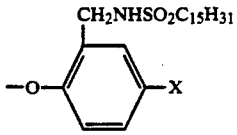

Where X represents, e.g., OH, $SO_3Na$ or $SO_3K$

B-6

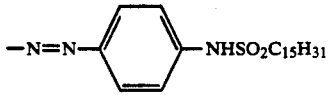

B-7

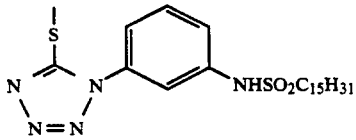

B-8

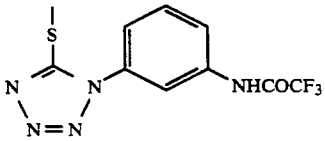

B-9

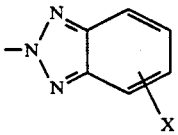

Where X represents, e.g., H, alkyl, alkoxy, halogen, $CO_2R$, $NHSO_2R$, NHCOR (R is long or short chain alkyl)

B-10

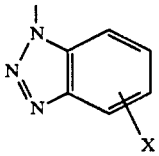

Where X represents, e.g., H, alkyl, alkoxy, halogen, $CO_2R$, $NHSO_2R$, NHCOR (R is long or short chain alkyl)

B-11

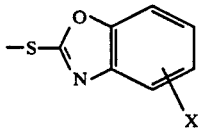

Where X represents, e.g., H, alkyl, alkoxy, halogen, $CO_2R$, $NHSO_2R$, NHCOR (R is long or short chain alkyl)

B-12

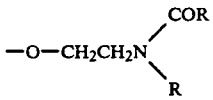

Where R represents, e.g., long or short chain alkyl

B-13

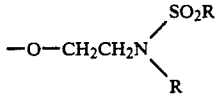

Where R represents, e.g., long or short chain alkyl

-continued

B-14

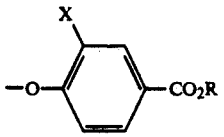

Where X represents, e.g., H, $SO_3Na$ or $SO_3K$ and R represents long chain alkyl or aralkyl

B-15

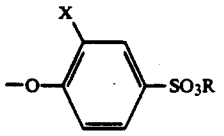

Where X represents, e.g., H, $SO_3Na$ or $SO_3K$ and R represents long chain alkyl or aralkyl

B-16

$-S-(CH_2)_nCO_2R$

Where n is, e.g., from 1 to 20 and R is long or short chain alkyl

B-17

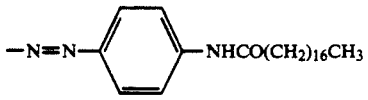

B-18

$-NHSO_2R$

Where R is e.g., substituted or unsubstituted alkyl or aryl

B-19

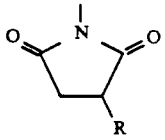

Where R is, e.g., H or long or short chain alkyl

It will be understood by one skilled in the art that the above listed coupler moieties, coupling-off groups, and ballast groups are representative and not exclusive. Further examples of such groups usable in the present invention are disclosed in U.S. Pat. Nos. 4,584,267 and 4,948,698, the disclosures of which are incorporated by reference above.

Exposed photographic elements containing coupler compounds of formula (I) according to the invention are developed with a color developer solution in order to form a heat transferable dye image. In principle, any combination of developer agent and coupler compound which forms a heat transferable dye upon development may be used. Selection of substituents for the coupler compounds of the invention as well as the developer agent will affect whether a heat transferable dye is formed upon development. Whether a particular coupler compound and developer agent combination generates a heat transferable dye suitable for use in the present invention will be readily ascertainable to one skilled in the art through routine experimentation.

Preferred color developing agents useful in the invention are p-phenylenediamines. Especially preferred are 4-amino-N,N-diethylaniline hydrochloride; 4-amino-3-methyl-N,N-diethylaniline hydrochloride; 4-amino-3-methyl-N-ethyl-N-(β-methanesulfonamidoethyl)aniline sulfate hydrate; 4-amino-3-methyl-N-ethyl-N-(β-hydroxyethyl) aniline sulfate; 4-amino-3-(β-methanesulfonamido)ethyl-N,N-diethylaniline hydrochloride; 4-amino-3-methyl-N-ethyl-N-(β-methanesulfonamidoethyl)aniline sesquisulfate monohydrate; and 4-amino-3-methyl-N-ethyl-N-(2-methoxyethyl)aniline di-p-toluenesulfonic acid.

Photographic elements in which the photographic couplers of formula (I) are incorporated can be simple elements comprising a support and a single silver halide emulsion layer, or they can be multilayer, multicolor elements. The silver halide emulsion layer can contain, or have associated therewith, other photographic addenda conventionally contained in such layers.

A typical mutilayer, multicolor photographic element according to this invention comprises a support having thereon a red sensitive silver halide emulsion layer having associated therewith a cyan dye image forming coupler compound, a green-sensitive silver halide emulsion layer having associated therewith a magenta dye image forming coupler compound and a blue sensitive silver halide emulsion layer having associated therewith a yellow dye image forming coupler compound. Each silver halide emulsion layer can be composed of one or more layers and the layers can be arranged in different locations with respect to one another. Typical arrangements are described in *Research Disclosure* Issue Number 308, pp. 993–1015, published December, 1989 (hereafter referred to as "*Research Disclosure*"), the disclosure of which is incorporated by reference.

The light sensitive silver halide emulsions can include coarse, regular or fine grain silver halide crystals of any shape or mixtures thereof and can be comprised of such silver halides as silver chloride, silver bromide, silver bromoiodide, silver chlorobromide, silver chloroiodide, silver chlorobromoiodide and mixtures thereof. The emulsions can be negative working or direct positive emulsions. They can form latent images predominantly on the surface of the silver halide grains or predominantly on the interior of the silver halide grains. They can be chemically or spectrally sensitized. The emulsions typically will be gelatin emulsions although other hydrophilic colloids as disclosed in *Research Disclosure* can be used in accordance with usual practice.

The support can be of any suitable material used with photographic elements. Typically, a flexible support is employed, such as a polymeric film or paper support. Such supports include cellulose nitrate, cellulose acetate, polyvinyl acetal, poly(ethylene terephthalate), polycarbonate, white polyester (polyester with white pigment incorporated therein) and other resinous materials as well as glass, paper or metal. Paper supports can be acetylated or coated with baryta and/or an alpha-olefin polymer, particularly a polymer of an alpha-olefin containing 2 to 10 carbon atoms such as polyethylene, polypropylene or ethylene butene copolymers. The support may be any desired thickness, depending upon the desired end use of the element. In general, polymeric supports are usually from about 3 μm to about 200 μm and paper supports are generally from about 50 μm to about 1000 μm.

The dye receiving layer to which the formed dye image is transferred according to the process of the invention may be present as a coated or laminated layer between the support and silver halide emulsion layer(s) of the photographic element, or the photographic element support itself may function as the dye receiving layer. Alternatively, the dye receiving layer may be in a separate dye receiving element which is brought into contact with the photographic element before or during the dye transfer step. If present in a separate receiving element, the dye receiving layer may be coated or laminated to a support such as those described for the photographic element support above, or may be self-supporting. In a preferred embodiment of the invention, the dye-receiving layer is present between the support and silver halide emulsion layer of an integral photographic element.

The dye receiving layer may comprise any material effective at receiving the heat transferable dye image. Examples of suitable receiver materials include polycarbonates, polyurethanes, polyesters, polyvinyl chlorides, poly(styrene-co-acrylonitrile)s, poly(caprolactone)s and mixtures thereof. The dye receiving layer may be present in any amount which is effective for the intended purpose. In general, good results have been obtained at a concentration of from about 1 to about 10 $g/m^2$ when coated on a support. In a preferred embodiment of the invention, the dye receiving layer comprises a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl) propane, bis(4-oxyphenyl)methane, 1,1-bis(4-oxyphenyl) ethane, 1,1-bis(oxyphenyl)butane, 1,1-bis(oxyphenyl) cyclohexane, 2,2-bis(oxyphenyl)butane, etc. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®. Further, a thermal dye transfer overcoat polymer as described in U.S. Pat. No. 4,775,657 may also be used.

Heating times of from about 10 seconds to 30 minutes at temperatures of from about 50° to 200° C. (more preferably 75° to 160° C., and most preferably 80° to 120° C.) are preferably used to activate the thermal transfer process. This aspect makes it possible to use receiver polymers that have a relatively high glass transition temperature (Tg) (e.g., greater than 100° C.) and still effect good transfer, while minimizing back transfer of dye (diffusion of dye out of the receiver onto or into a contact material).

While essentially any heat source which provides sufficient heat to effect transfer of the developed dye image from the emulsion layer to the dye receiving layer may be used, in a preferred embodiment dye transfer is effected by running the developed photographic element with the dye receiving layer (as an integral layer in the photographic element or as part of a separate dye receiving element) through a heated roller nip. Thermal activation transport speeds of about 0.1 to 50 cm/sec are preferred to effect transfer at nip pressures of from about 500 Pa to about 1,000 kPa and nip temperatures of from about 75° to 190° C.

Thermal solvents may be added to any layer(s) of the photographic element (and separate receiving element) in order to facilitate transfer of the formed dye image from the emulsion layer to the dye receiving layer. Preferred thermal solvents are alkyl esters of meta- and para-hydroxy benzoic acid, which have been found to be particularly effective in facilitating dye transfer through dry gelatin as described in concurrently filed, copending, commonly assigned U.S. Ser. No. 07/804,868 of Bailey et al., the disclosure of which is incorporated by reference.

After the dye image is transferred, the dye-receiving layer may be separated from the emulsion layers of the photographic element by stripping one from the other. Automated stripping techniques applicable to the present invention are disclosed in copending U.S. Ser. No. 07/805,717 of Texter et al., the disclosure of which is incorporated by reference.

Further details regarding silver halide emulsions and elements, and addenda incorporated therein can be found in *Research Disclosure,* referred to above.

The terms "in association" or "associated with" are intended to mean that materials can be in either the same or different layers, so long as the materials are accessible to one another.

Photographic elements as described above are exposed in the process of the invention. Exposure is generally to actinic radiation, typically in the visible region of the spectrum, to form a latent image as described in *Research Disclosure* Section XVIII. The exposure step may also include exposure to radiation outside the visible region.

The following examples are provided to help further illustrate the invention.

EXAMPLE 1

Dispersions of coupler compounds A and B in di-n-butylphthalate (1 part coupler to 0.25 parts solvent) were made and coated at 0.54 $g/m^2$ of coupler with 0.32 $g/m^2$ of silver as a silver chloride emulsion and 1.6 $g/m^2$ of gelatin on two supports, S1 and S2. S1 was a reflection support consisting of polycarbonate overcoated with polycaprolactone and tinted with titanium dioxide. S2 was a reflection support consisting of polyethylene coated on paper and tinted with titanium dioxide. These coatings were given a stepped exposure and processed for 45 seconds at room temperature in a developer solution consisting of:

Triethanolamine, 12.41 g,
Phorwite REU (Mobay) brightening agent, 2.3 g,
Lithium polystyrenesulfonate, 0.1 g,
N,N-diethylhydroxylamine, 4.6 g,
KODAK color developing agent CD3, (4-amino-3-methyl-N-ethyl-N-(β-methanesulfonamidoethyl) aniline sesqisulfate monohydrate) 5 g,
1-Hydroxyethyl-1,1-diphosphonic acid, 0.7 g,
Potassium carbonate, 21.2 g,
Potassium bicarbonate, 2.8 g,
Potassium chloride, 1.6 g,
Potassium bromide, 7 mg,
Water to make 1L, pH 10.04 at 26.7° C.

Following development, strips were treated for 45 seconds with 3% aqueous acetic acid, 1.5 minutes in a solution of 30 g/L of sodium sulfate in water and dried for 30 minutes at 60° C.

There was a good image scale in all cases consisting of dye (cyan in the case of coupler A and magenta in the case of coupler B) plus developed silver. The background was clean of dye but contained the unreacted silver chloride.

The Dmax densities were recorded. This is the total density (Dt). Each strip was then cut in two pieces. The gel layer was washed off the supports from one piece and the Dmax densities recorded again. These densities (Dc) were caused by the dye that had transferred to the support during the wet treatment steps or in the heated drier. The second pieces were heated at 185° C. for 60 seconds. The gel layer was then peeled off the supports by hand. The densities (Dh) of the dyes on the supports were recorded. These results are in Table I.

TABLE I

| Coupler A (Cyan Dye) | Coupler B (Magenta Dye) |
|---|---|

TABLE I-continued

| | S1 | S2 | S1 | S2 |
|---|---|---|---|---|
| Dt | 1.85 | 1.60 | 1.80 | 1.72 |
| Dc | 0.80 | 0.12 | 0.60 | 0.25 |
| Dh | 1.60 | 0.55 | 1.74 | 0.59 |

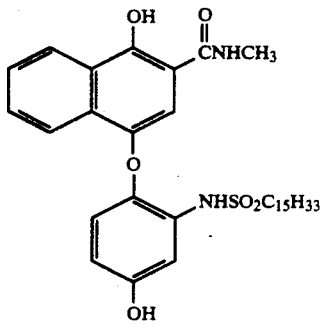

Cyan Coupler A

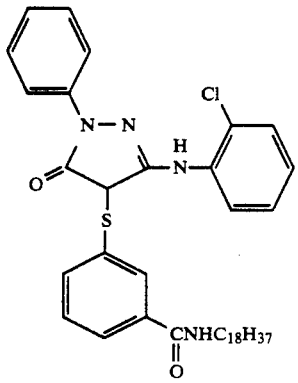

Magenta Coupler B

This example illustrates that the couplers described formed dyes, in a conventional color development process, which were heat transferred to the appropriate integral receiver leaving all the silver behind in the gelatin coating. The gelatin layer was peeled off to reveal the transferred image.

EXAMPLE 2

Couplers A and B, along with Coupler C were dispersed in di-n-butylpthalate at 1 part coupler to 0.5 part solvent. Single layer test coatings containing 1.08 g $Ag/m^2$ (as AgCl), 1.6 $g/m^2$ gelatin, 0.86 $g/m^2$ coupler, and hardener (1,1'-[methylenebis (sulfonyl)]bis-ethene) at 1.5 wt % of the gelatin. Strips were exposed to white light through a step tablet and processed at 35° C. in the developer solution described in Example 1, bleach-fixed, washed, and dried. Bleach-fixing was performed for experimental purposes only in order to remove silver from the photographic element to facilitate measurement of total dye densities before transfer of the dye image out of the emulsion layer.

Processed strips were then heat treated to transfer the image to a receiver S3 which consisted of a polycarbonate layer coated on a MYLAR polyester support that had been tinted with titanium dioxide. The test strips were placed emulsion side against the receiver, and passed at 0.36 cm/sec through heated pinch rollers at 160° C. and a nip pressure of 138 kPa. Dmax and Dmin data are listed in Table II. DmaxT (DminT) densities are readings obtained by reading through the donor strip while it is superimposed upon the transferred image on the receiver. DmaxD (DminD) are readings of the transferred image on the receiver.

TABLE II

| | DmaxT | DmaxD | DminT | DminD |
|---|---|---|---|---|
| A | 2.48 | 0.48 | 0.17 | 0.10 |
| B | 2.61 | 2.04 | 0.45 | 0.21 |
| C | 2.50 | 0.68 | 0.17 | 0.08 |

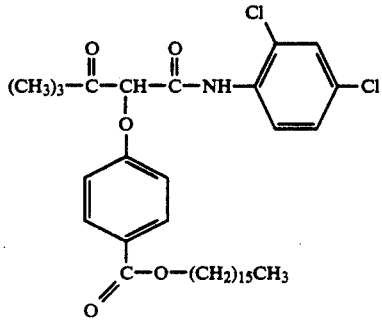

Yellow Coupler C

The above results demonstrate that conventionally developed dye images can be heat transferred from an emulsion layer of a photographic element to a polymeric dye receiving layer of a separate receiving element.

EXAMPLE 3

Coatings of the magenta coupler B were made as described above in Example 2, except that the amount of hardener was varied at 1.5%, 1.13%, 0.75% and 0.37% of the gelatin. These strips were exposed and processed as described above in Example 2. Heat transfer was also done as in Example 2, except the receiver material S1 was used. DmaxT (DminT) and DmaxD (DminD) data for these strips are listed in Table III.

TABLE III

| % Hardener | DmaxT | DmaxD | DminT | DminD |
|---|---|---|---|---|
| 1.5 | 2.60 | 2.03 | 0.29 | 0.13 |
| 1.13 | 2.66 | 2.23 | 0.35 | 0.22 |
| 0.75 | 2.66 | 2.37 | 0.30 | 0.20 |
| 0.37 | 2.61 | 2.32 | 0.43 | 0.33 |

The above results demonstrate that effective dye transfer is achieved at various levels of hardener.

The invention has been described in detail with particular reference to preferred embodiments thereof, but it will be understood that variations and modifications can be effected within the spirit and scope of the invention.

What is claimed is:

1. A process for forming a dye image comprising the steps of:

(a) exposing a photographic element comprising a support bearing a light sensitive silver halide emulsion layer containing a color coupler compound capable of forming a heat transferable dye upon aqueous development;

(b) developing the exposed element resulting from step (a) with an aqueous color developer solution to form a heat transferable dye image;

(c) washing the developed element resulting from step (b) in an aqueous acidic stop bath;

(d) drying the developed and washed element resulting from step (c);

(e) heating the exposed, developed, washed, and dried element resulting from step (d) to thereby transfer the heat transferable dye image from the developed silver halide emulsion layer to a dye receiving layer which is part of the photographic element or part of a separate dye receiving element brought into contact with the photographic element, where said heating comprises exposing the element to a temperature of from 50° C. to 200° C. for from 10 seconds to 30 minutes; and (f) separating the developed, washed, dried, and heated silver halide emulsion layer from the dye receiving layer containing the transferred dye image; wherein the color coupler compound is of the formula:

COUP—B wherein

COUP represents a coupler moiety capable for forming a heat transferable dye upon reaction of the coupler compound with an oxidized product of the color developer solution of step (b); and B is a hydrogen or a coupling-off group which is separated from COUP upon reaction of the coupler compound with an oxidized product of the color developer solution of step (b).

2. The process of claim 1, wherein B is a ballasted coupling-off group having a sufficient molecular size or shape to render undeveloped coupler compound of formula COUP-B substantially immobile in the emulsion layer.

3. The process of claim 2, wherein the color developer solution comprises a p-phenylenediamine.

4. The process of claim 3, wherein the color developer solution comprises 4-amino-N,N-diethylaniline hydrochloride; 4-amino-3-methyl-N,N-diethylaniline hydrochloride; 4-amino-3-methyl-N-ethyl-N-(β-methanesulfonamidoethyl)aniline sulfate hydrate; 4-amino-3-methyl-N-ethyl-N-(β-hydroxyethyl) aniline sulfate; 4-amino-3-(β-methanesulfonamido)ethyl-N,N-diethylaniline hydrochloride; 4-amino-3-methyl-N-ethyl-N-(β-methanesulfonamidoethyl)aniline sesquisulfate monohydrate; or 4-amino-3-methyl-N-ethyl-N-(2-methoxyethyl)aniline di-p-toluenesulfonic acid.

5. The process of claim 1 wherein the dye receiving layer comprises a polycarbonate, polyurethane, polyester, polyvinyl chloride, poly(styrene-co-acrylonitrile), poly(caprolactone) or a mixture thereof.

6. The process of claim 1 wherein the dye receiving layer is an integral layer of the photographic element.

7. The process of claim 6, wherein the dye receiving layer is present between the support and the emulsion layer of the photographic element, and wherein after the dye image is transferred from the emulsion layer to the dye receiving layer, the emulsion layer is separated from the dye receiving layer.

8. The process of claim 1, wherein the dye receiving layer is present in a separate dye receiving element, and further comprising the step of bringing together the dye receiving element and the photographic element prior to or during heating step (e).

9. The process of claim 1, wherein heating step (e) comprises exposing the photographic element to a temperature of from 75° C. to 160° C. for from 10 seconds to 30 minutes.

10. The process of claim 9, wherein heating step (e) comprises exposing the photographic element to a temperature of from 80° C. to 120° C. for from 10 seconds to 30 minutes.

11. The process of claim 1, wherein heating step (e) comprises running the photographic element and receiving layer through rollers at a temperature of 75° C. to 190° C., a pressure of 500 Pa to 1,000 kPa, and a speed of 0.1 cm/s to 50 cm/s.

12. The process of claim 1, wherein the silver halide emulsion is a negative working silver halide emulsion.

13. The process of claim 1, wherein the silver halide emulsion is a silver chloride emulsion.

* * * * *